US006079082A

United States Patent [19]

Riter et al.

[11] Patent Number: 6,079,082

[45] Date of Patent: Jun. 27, 2000

[54] GIN RIB

[75] Inventors: Edward Michael Riter, Selma; Frank R. Clark, Jr., Prattville, both of Ala.

[73] Assignee: Continental Eagle Corporation, Prattville, Ala.

[21] Appl. No.: 09/198,618

[22] Filed: Nov. 24, 1998

[51] Int. Cl.[7] ..... D01B 1/08

[52] U.S. Cl. ..... 19/62 R; 19/48 R

[58] Field of Search ..... 19/39, 40, 41, 19/48 R, 55 R, 62 R, 63

[56] References Cited

U.S. PATENT DOCUMENTS 132,217 10/1872 Robison ..... 19/62 R
206,847 8/1878 Williams ..... 19/62 R
268,007 11/1882 Garlington ..... 19/62 R
310,193 1/1885 Edwards ..... 19/62 R
417,849 12/1889 Abernethy ..... 19/62 R

*Primary Examiner*—Michael A. Neas
*Assistant Examiner*—Gary L. Welch
*Attorney, Agent, or Firm*—Jacobson, Price, Holman & Stern, PLLC

[57] ABSTRACT

A removable wear finger or plate is held in position on a gin rib by a machine screw on one end passing through a bore in the wear finger and an overlying cantilever retainer lip on an opposite end. The screw when tightened urges the wear finger toward the cantilever retainer lip.

12 Claims, 4 Drawing Sheets

GIN RIB

BACKGROUND OF THE INVENTION

FIELD OF THE INVENTION

The subject invention is in the field of cotton gins and is specifically directed to a gin rib having improved wear characteristics and which is easily serviced in a minimum amount of time without requiring disassembly of the gin unit.

Conventional saw-type cotton gins employ a gin stand in which a plurality of spaced parallel saw blades are mounted for coaxial rotation with respect to each other with individual gin ribs interleaved with the saw blades so that one gin rib is positioned between adjacent saw blades to cooperate with the blades effect separation of the seed from the cotton fiber. In operation, the saw blades engage the fiber and pull it through the space between blades and their respective adjacent gin ribs with such space being of such a narrow dimension as to preclude the passage of the seeds so as to effectively separate the fiber from the seed.

The portion of each gin rib adjacent the saw blades is the area where the fiber and the seed are separated and is referred to as the ginning point. It is well known that gin ribs are subjected to excessive wear in and around the ginning point due to the friction with the seed and the fiber. Such excessive wear will result in the need for replacement of the gin ribs which is a time consuming and expensive procedure since the gin is necessarily out of operation during such procedure. One reason for the substantial amount of time required for replacing gin ribs is the fact that the clearance space between the gin ribs and their adjacent saw blades is quite small and any misalignment can result in sparks and a disastrous fire in the gin. Thus, it is essential that the gin ribs be accurately positioned when replaced and such replacement can be a tedious and time consuming procedure.

It has been previously proposed to provide sacrificial wear plates or similar members removably attached to gin ribs at the ginning point so as to avoid the expense of having to completely replace worn gin ribs. Unfortunately, many of the prior known gin ribs employing such replaceable wear members require removal of the gin ribs in order to replace the wear member. Thus, the installation of the sacrificial wear members frequently requires the total removal of the gin ribs causing substantial down time for the gin and resultant expense to the ginning operation Also, the various procedures for retaining the sacrificial wear members in the position on the gin rib must be reliable since failure of the retaining means for a sacrificial wear portion can result in substantial mechanical damage and fire in the gin itself with disastrous consequences. Unfortunately, some of the prior retention means for wear plates have not been reliable and have caused substantial gin damage.

Therefore, it is a primarily object of the present invention to provide a new and improved gin rib.

A further object of the present invention is the provision of a new and improved gin rib incorporating a sacrificial wear portion.

Another object of the present invention is a provision of a new and improved gin rib on which a sacrificial wear portion is provided in a manner so that the wear portion can easily be removed for replacement without removal of the gin rib itself from the gin.

Yet another object of the present invention is the provision of a new improved gin rib in which a sacrificial wear portion is connected to the gin rib for attachment or removal by a single clamping member which provides secure retention of the wear portion on the gin rib.

BRIEF SUMMARY OF THE INVENTION

Obtainment of the foregoing objects is enabled by the preferred embodiment of the invention which comprises a gin rib consisting of a main rib component having upper and lower ends a curved outer surface in the ginning area in which a sacrificial wear finger or plate having upper and lower ends is removably positioned. The wear prone area is provided on the arcuately curved surface in which the elongated wear finger is positioned so as to extend through the ginning point. A blind threaded bore is provided adjacent the upper end of the wear prone area for receiving a threaded machine screw extending through an unthreaded bore provided on the upper end of the wear finger. The lower extent of the wear prone area of the gin rib is defined by a cantilever retaining lip extending in cantilever manner from the gin rib component and spaced above the lower end of the wear finger. The lower end of the sacrificial wear finger is defined by a lower V-shaped portion having a thickness equal to one-half the thickness of the remainder of the sacrificial wear finger member and which is received beneath the cantilever retaining lip portion previously described. The lower V-shaped portion of the sacrificial wear finger has a V-shaped surface which matingly engages a V-shaped surface of the main rib component beneath the aforementioned cantilever retainer lip.

The upper end of the sacrificial wear finger includes a non-threaded plain bore of sufficient diameter to permit the positioning of an machine screw extended therethrough with a small amount of clearance between the non-threaded plain bore in the wear finger and the machine screw. The threads of the machine screw are threaded into the threads of the blind threaded bore of the main rib component. The upper end of the non-threaded plain bore in the wear finger communicates, with a conical countersink surface which is eccentric with respect to the axis of the plain non-threaded bore. Thus, the axis of the conical countersink portion is not coextensive with the axis of the plain unthreaded bore and is displaced a small distance toward the upper end of the sacrificial wear finger from the axis of the non-threaded bore. The head of the machine screw has a conical lower surface that is essentially parallel to the conical countersink surface in the main rib component. Consequently, the tightening of the machine screw conical surface on the machine screw head engages the conical countersink surface of the wear finger bore when the machine screw is tightened so as to forcefully cam the sacrificial wear finger downwardly toward the cantilever retaining lip portion of the main rib component so as to effectively lock both the lower end and the upper end of the sacrificial wear finger in position on the gin rib.

The upper end of the sacrificial wear finger is positioned so that the machine screw provided in the non-threaded bore of the wear finger is easily accessible from the exterior of the gin so as to facilitate an easy removal and replacement of the sacrificial wear finger when required. Such removal does not necessitate removal of the gin rib and is consequently resultant in a substantial savings of time and an increase in profitability for the operator.

DETAILED DESCRIPTION OF THE PREFERRED EMBODIMENT

Figure 1:
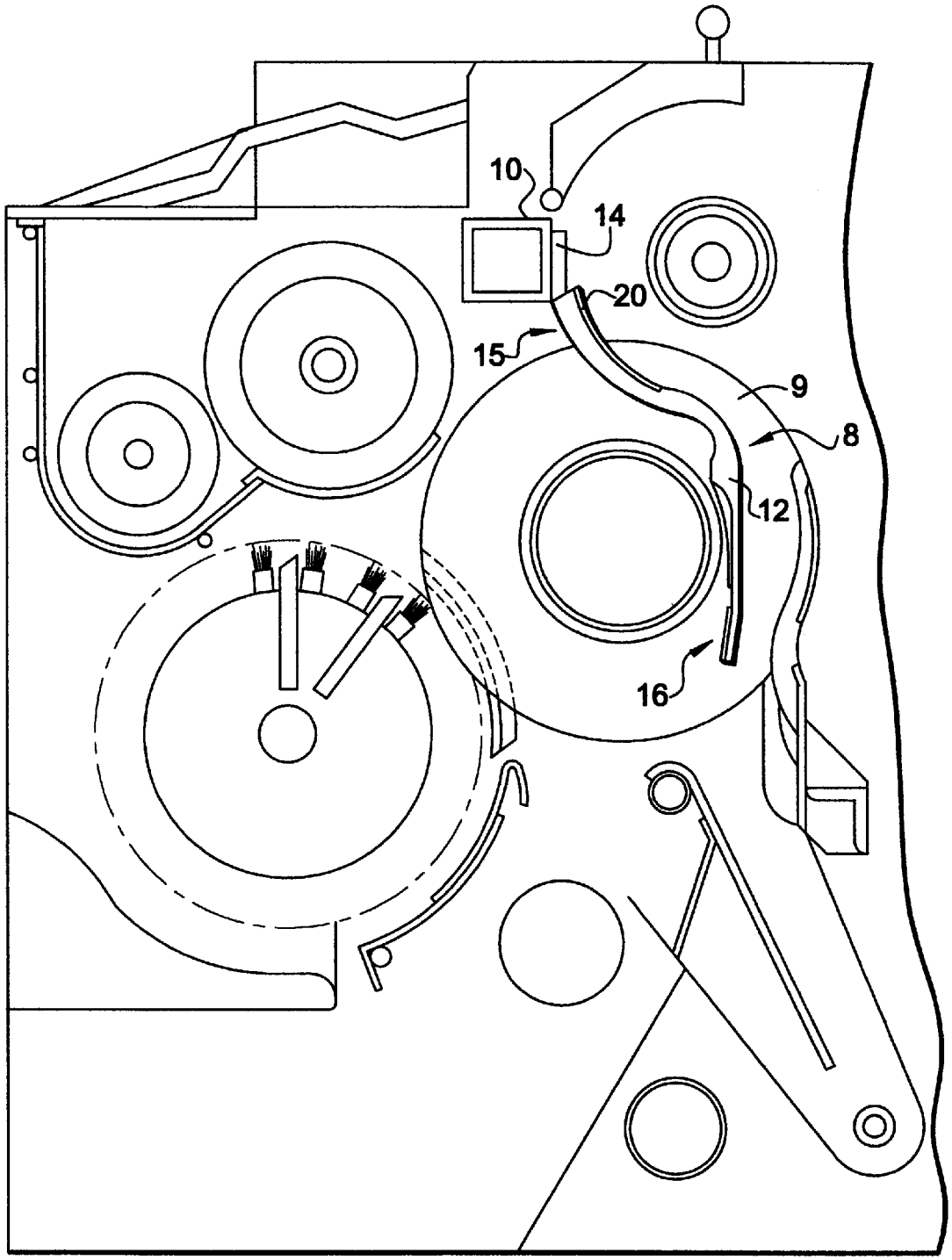
FIG. 1 is a side elevation view illustrating the preferred embodiment of the invention installed in a typical conventional gin.

The preferred embodiment of the invention comprises a gin rib generally designated 8 which is positioned on a cross beam 10 in a conventional gin adjacent saw blades 9 between which such gin ribs are interleaved in well-known manner as shown in FIG. 1. The outer periphery of saw blade 9 is positioned adjacent a portion of the gin rib referred to as the ginning point and which area of the rib is subject to maximum wear.

Figure 2:
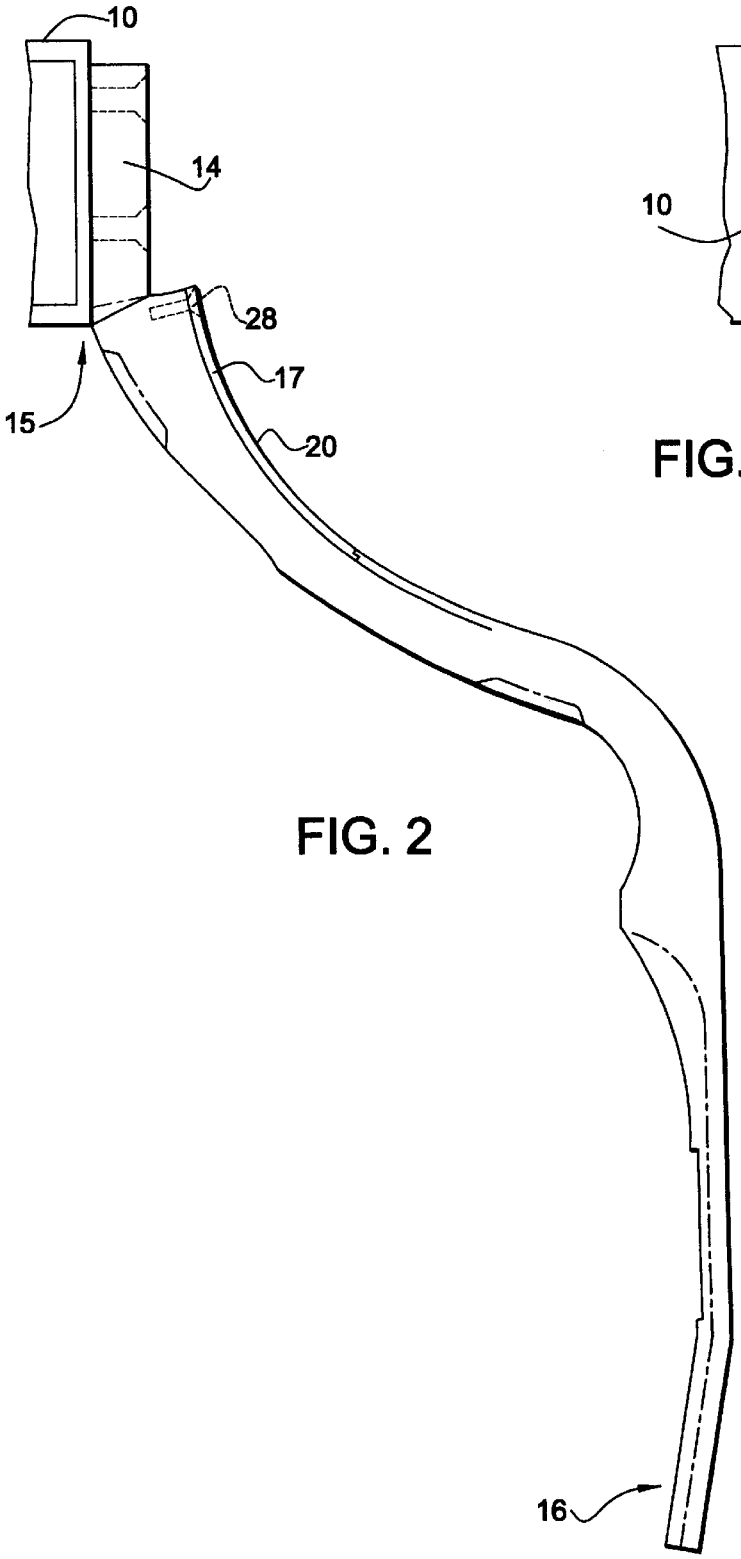
FIG. 2 is a side elevation of the preferred embodiment of the invention.
Figure 3:
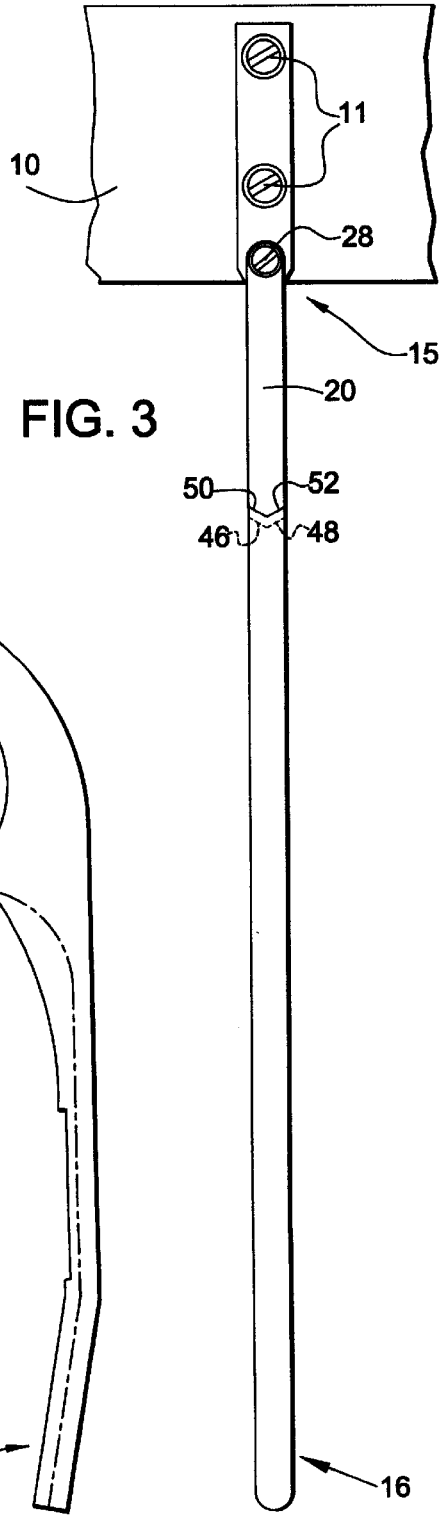
FIG. 3 is a front elevation view of the preferred embodiment.

The preferred embodiment 8 of the invention comprises a main rib component 12 having an attachment fitting 14 in its upper end area 15 and a downwardly extending lower end 16. Machine screws 11 provide a sturdy and accurate attachment of the gin rib to the cross beam 10 in a manner best shown in FIGS. 2 and 3.

Figure 5:
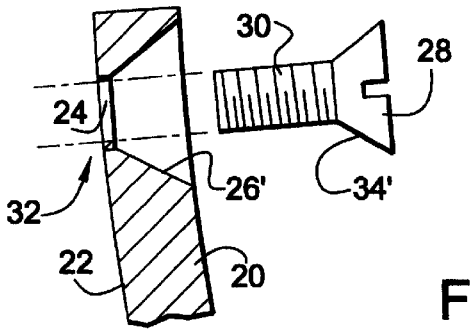
FIG. 5 is an enlarged sectional view taken along lines 5—5 of FIG. 4.
Figure 6:
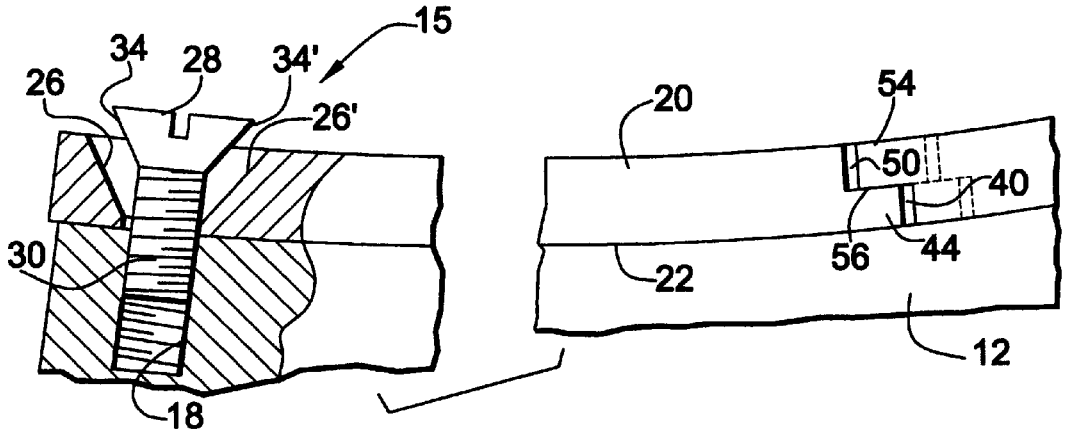
FIG. 6 is a sectional view illustrating the initial step in the positioning of the wear finger on the main rib component.

The upper end of main rib component 12 is provided with an arcuate forwardly facing wear finger support surface 17 at the upper end of which a blind threaded bore 18 is provided. The wear finger or plate 20 is made of wear resistant metal or other material having a curved rear surface 22 of the same shape as surface 17 on which finger 20 is positioned. The upper end of wear finger 20 is provided with a countersunk bore 24 defining a conical surface 26. A machine screw 28 is dimensioned to be positioned in countersunk bore 24 so that the threaded portion 30 of the machine screw has a small amount of clearance 32 from bore 24 as shown in FIGS. 5 and 6. The head of machine screw 28 also has a lower conical surface 34 which faces conical surface 26.

Figure 4:
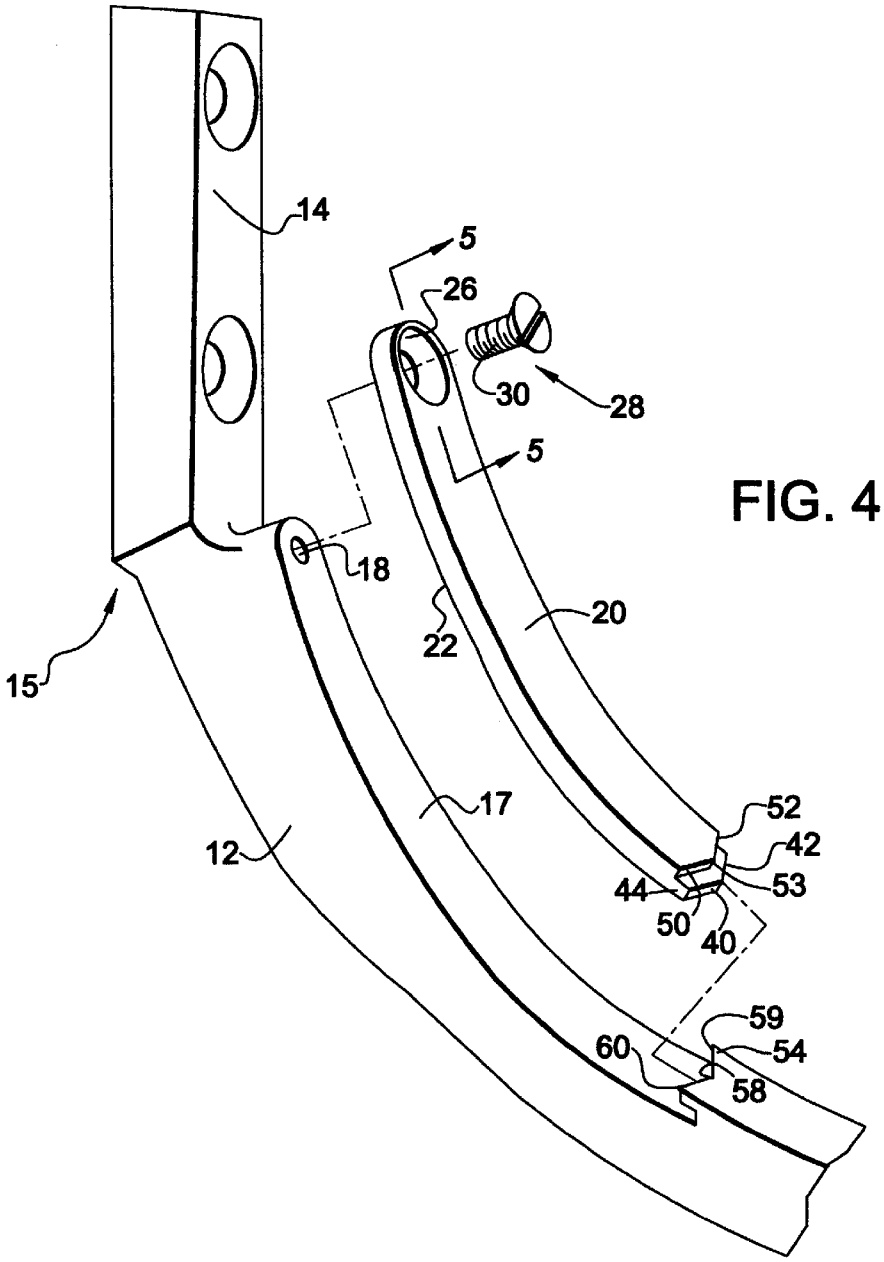
FIG. 4 is a perspective exploded view of the preferred embodiment.

The lower end of the wear finger of plate 20 is defined by two pointed surfaces comprising an inner pointed surface formed by flat planar surfaces 40 and 42 on a lower lock lip 44 having a thickness of approximately 50% of the entire thickness of finger 20 as shown in FIG. 4. Similarly, the upper portion of wear finger 20 at its lower end is defined by first and second surfaces 50 and 52 which intersect at an apex 53 in the middle of member 20 as shown in FIG. 4.

A cantilever retainer lip 54 formed in main rib component 12 is positioned over lower lock lip 44 and has a lower surface 56 engaging the upper surface 46 of lower lock lip 44 as shown in FIG. 6. The outer extent of cantilever retainer lip 54 is defined by a V-shaped surface having an apex 58 and surfaces 59 and 60 as shown in FIG. 4 and which is of exactly the same configuration as the surfaces 50 and 52 of finger member 20.

Figure 7:
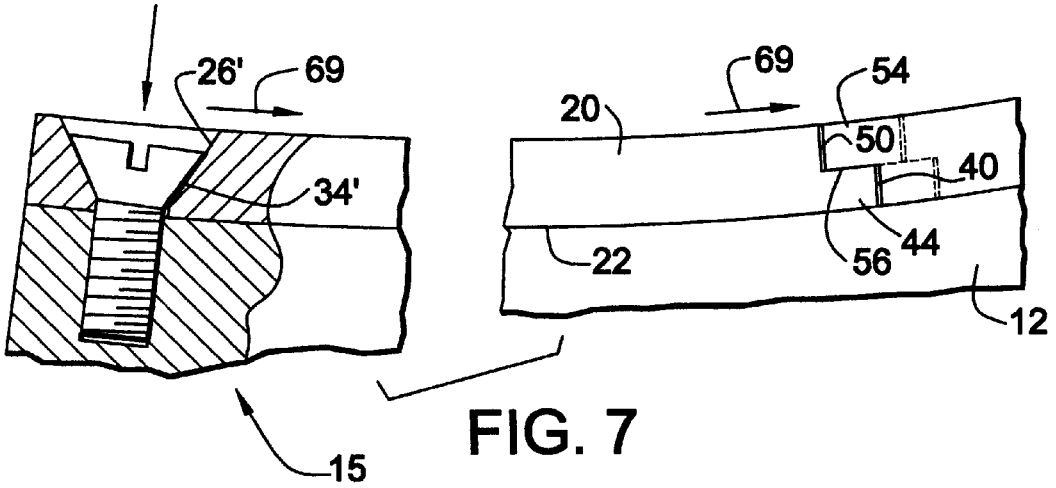
FIG. 7 is a sectional view similar to FIG. 6 but illustrating the wear finger in a subsequent position to that of FIG. 6 locked in the retaining means of the main rib component.

The sacrificial finger or wear plate 20 is installed by positioning surface 22 on curved surface 17 of the main rib component 12 with lower lock lip 44 being partially positioned beneath cantilever retainer lip 54 and countersunk bore 24 being aligned with blind threaded bore 18 in the position as shown in FIG. 6. Machine screw 28 is threaded into the blind threaded bore 18 and the lower side 34' of conical surface 34 is more closely spaced from the lower portion 26' of the conical surface 26 of finger 20 than is the upper portion of conical surface 34 with respect to the upper portion of conical portion 26. Consequently, tightening movement of machine screw 28 from the position in FIG. 6 to the position shown in FIG. 7 causes machine screw surface 34' to engage wear finger surface 26' and cam finger member 20 to the right in the direction of arrows 69 as shown in FIG. 7. The movement of finger 20 to the right causes the lower lock lip 44 to move fully under cantilever retainer lip 54 so that the lower end of finger 20 is firmly locked in place by engagement of lower end surfaces 40 and 42 of finger 20 with surfaces 46 and 48 of gin rib 12. The upper end surfaces 50 and 52 of finger 20 similarly engage outer end surfaces 59 and 60 of cantilever retainer lip 54.

Thus, it will be seen that the wear finger or plate 20 is firmly locked in position by the reaction of machine screw 28 the upper end of the wear plate and the retention of the lower end of the wear plate by the cantilever retainer lip 54. Moreover, the wear finger or plate 20 can be easily removed by simply removing machine screw 28 and pulling the finger 20 from the gin without any need for removing the main rib component 12 from the gin. Additionally, the wear finger is firmly locked in place and the chances of it becoming dislodged during operation of the gin are practically nil.

It should be understood that the spirit and scope of the invention is to be limited solely by the appended claims and that the invention may be practiced in ways that are different from the preferred embodiment of the invention.

What is claimed is:

1. A gin rib comprising a main rib component having upper and lower ends and an outer support surface adjacent a wear prone area; a sacrificial wear finger having upper and lower ends and being removably mountable on said outer support surface so as to permit removal and replacement of said wear finger when desired, first retaining means engageable with one end of said wear finger for retaining said one end of said wear finger on said outer support surface and a second retainer means engageable with the other end of said wear finger for retaining said other end of said wear finger on said outer support surface and for moving said wear finger longitudinally along said outer support surface toward and into snug contact with said first retaining means on said support surface so as to provide secure retention of said wear finger on said support surface.

2. A gin rib as recited in claim 1, wherein said first retainer means includes a cantilever retainer lip formed in said gin rib and overlying a portion of said one end of said wear finger.

3. A gin rib as recited in claim 2, wherein said second retainer means comprises a threaded member threadably received in said gin rib beneath said wear finger and including an upper downwardly facing wear finger engaging means forcefully engaged with said second end of said wear finger to urge said wear finger longitudinally to force one end of said wear finger into and beneath said cantilever retainer lip.

4. A gin rib as recited in claim 3, wherein said gin rib includes a blind threaded bore having a blind bore axis and said wear finger includes a countersunk bore having a conical countersunk surface having a countersunk axis and said threaded member comprises a machine screw positioned in said blind threaded bore and having a screw axis and a head with a lower conical surface facing and engaging said conical countersunk surface of said wear finger and wherein said blind bore axis is offset relative to said countersunk axis so that axial movement of said machine screw into said blind threaded bore causes said lower conical surface of the machine screw head to engage and react with the countersunk bore of said wear finger to urge the wear finger longitudinally toward said cantilever retainer lip.

5. A gin rib as recited in claim 2, wherein said cantilever retainer lip means has an outer end termination of V-shaped configuration and said one end of said wear finger includes a V-shaped surface which is of the same configuration as the outer end termination of said cantilever retainer lip means and which is matingly received in said outer end termination of said cantilever retainer lip means.

6. A gin rib as recited in claim 5, wherein said second retainer means comprises a threaded member threadably received in said gin rib beneath said wear finger and including an upper downwardly facing wear finger engaging means forcefully engaged with said second end of said wear finger to urge said wear finger longitudinally to force said one end of said wear finger into and beneath said cantilever retainer lip.

7. A gin rib as recited in claim 6, wherein said gin rib includes a blind threaded bore having a blind bore axis and said wear finger includes a countersunk bore having a conical countersunk surface having a countersunk axis and said threaded member comprises a machine screw positioned in said blind threaded bore and having a screw axis and a head with a lower conical surface facing and engaging said conical countersunk surface of said wear finger and wherein said blind bore axis is offset relative to said countersunk axis so that axial movement of said machine screw into said blind threaded bore causes said lower conical surface of the machine screw head to engage and react with the countersunk bore of said wear finger to urge the wear finger longitudinally toward cantilever retainer lip.

8. A gin rib as recited in claim 2, wherein said wear finger portion includes a lower lock lip extending beneath said cantilever retainer lip of said gin rib and having a V-shaped outer end surface matingly received in a V-shaped surface of the same configuration provided in said gin rib.

9. A gin rib as recited in claim 8, wherein said cantilever retainer lip has an outer end termination of V-shaped configuration and said one end of said wear finger includes a V-shaped surface which is of the same configuration as the V-shaped outer end surface of said cantilever retainer lip and is matingly received in said V-shaped outer end surface of said cantilever lip retainer.

10. A gin rib as recited in claim 9, wherein said second retainer means comprises a threaded member threadably received in said gin rib beneath said wear finger and including an upper downwardly facing finger engaging means forcefully engaged with said second end of said wear finger to urge said wear finger longitudinally to push said one end of said wear finger into the cantilever retainer lip.

11. A gin rib as recited in claim 10, wherein said gin rib includes a blind threaded bore having a blind bore axis and said wear finger includes a countersunk bore having a conical countersunk surface having a countersunk axis and said threaded member comprises a machine screw threadably received in said blind threaded bore having a screw axis and a head with a lower surface facing and engaging said conical countersunk surface of said wear finger and wherein said blind bore axis is offset relative to said countersunk axis so that axial movement of said machine screw into said blind threaded bore causes said lower surface of the machine screw head to engage and react with the countersunk bore of said wear finger to urge the wear finger longitudinally toward said overlying portion of said cantilever retainer lip.

12. A gin rib as recited in claim 1, wherein said one end of said wear finger is said lower end of said wear finger.

* * * * *